US009404710B1

(12) United States Patent
Beard et al.

(10) Patent No.: US 9,404,710 B1
(45) Date of Patent: Aug. 2, 2016

(54) HOLSTER FOR A HANDGUN

(75) Inventors: Nathan Beard, Lexington, NC (US); Nathan B. Johnson, Lexington, NC (US)

(73) Assignee: N82 Tactical, Inc., Lexington, NC (US)

( * ) Notice: Subject to any disclaimer, the term of this patent is extended or adjusted under 35 U.S.C. 154(b) by 0 days.

(21) Appl. No.: 13/552,129

(22) Filed: Jul. 18, 2012

(51) Int. Cl.
*F41C 33/02* (2006.01)

(52) U.S. Cl.
CPC ..... *F41C 33/0209* (2013.01)

(58) Field of Classification Search
CPC ..... Y10S 224/911; Y10S 224/912; Y10S 224/904; Y10S 224/907; F41C 33/0209; F41C 33/048; F41C 33/0263
USPC ..... 224/192, 193, 587, 242, 243, 911, 912, 224/666, 667; 113/192, 193, 587, 242, 243, 113/911, 912, 666, 667
See application file for complete search history.

(56) References Cited

U.S. PATENT DOCUMENTS

| | | | | | |
|---|---|---|---|---|---|
| 2,576,231 | A | | 11/1951 | Lawson, Jr. et al. | 224/2 |
| 3,289,903 | A | * | 12/1966 | Taormina | 224/244 |
| 3,583,612 | A | | 6/1971 | Theodore | 224/2 |
| 3,731,858 | A | | 5/1973 | Baker | 224/2 |
| 3,942,692 | A | | 3/1976 | Chica | 224/2 |
| 4,022,361 | A | | 5/1977 | Devlin | 224/2 |
| 4,062,481 | A | | 12/1977 | Clark | 224/2 |
| 4,667,374 | A | | 5/1987 | Bianchi | 24/3 |
| 4,718,585 | A | | 1/1988 | Atkins, Sr. | 224/238 |
| 4,785,983 | A | | 11/1988 | DeSantis | 224/206 |
| 5,054,671 | A | * | 10/1991 | Else | F41C 33/0209 224/192 |
| 5,265,781 | A | | 11/1993 | Nichols | 224/198 |
| 5,419,474 | A | * | 5/1995 | Marx et al. | 224/244 |
| 5,445,303 | A | | 8/1995 | Cawile, Jr. | 224/222 |
| 5,570,827 | A | | 11/1996 | Wiesner | 224/587 |
| 5,816,459 | A | * | 10/1998 | Armistead | 224/246 |
| 6,050,465 | A | * | 4/2000 | Nelson et al. | 224/243 |
| 6,089,432 | A | | 7/2000 | Gage et al. | 224/587 |
| 6,092,703 | A | | 7/2000 | Johnson | 224/198 |
| 6,264,079 | B1 | * | 7/2001 | Skaggs | 224/193 |
| 6,398,089 | B1 | | 6/2002 | Har-Shen | 224/192 |
| 6,571,997 | B2 | * | 6/2003 | Dedrick | 224/183 |
| 6,685,066 | B2 | | 2/2004 | Cragg | 224/192 |
| 6,814,270 | B2 | | 11/2004 | Mason | 224/587 |
| 7,258,259 | B1 | * | 8/2007 | Owens | 224/193 |
| 7,314,152 | B1 | * | 1/2008 | Garrett | 224/192 |
| D620,705 | S | | 8/2010 | Beard et al. | D3/222 |
| 8,074,850 | B2 | * | 12/2011 | Soderquist | F41C 33/0227 224/243 |
| 2005/0127121 | A1 | * | 6/2005 | Wells | 224/193 |
| 2006/0219743 | A1 | * | 10/2006 | Gallagher | 224/192 |
| 2010/0181353 | A1 | * | 7/2010 | Craighead | 224/193 |
| 2010/0270349 | A1 | | 10/2010 | Craighead | 224/587 |
| 2012/0223110 | A1 | * | 9/2012 | Gregory | F41C 33/0263 224/193 |
| 2013/0320055 | A1 | * | 12/2013 | King | 224/243 |

* cited by examiner

*Primary Examiner* — Adam Waggenspack
(74) *Attorney, Agent, or Firm* — MacCord Mason PLLC

(57) ABSTRACT

A holster for carrying a handgun inside a wearer's beltline. In one embodiment, the holster includes a body-interface-surface (BIS) having a body-side (BS) and a gun-side (GS). A rigid mold is interfaced with the BIS. In another embodiment, the BIS may include a gun-lock region. A clip may be interfaced with the rigid mold. Other embodiments include methods of making the holster.

34 Claims, 9 Drawing Sheets

HOLSTER FOR A HANDGUN

This application claims the benefit of Provisional Application Ser. No. 61/510,616 filed Jul. 22, 2011.

BACKGROUND (1) Field

The present inventions relate generally to handgun holsters and, more particularly, to holsters designed to carry a handgun inside the waistline.

(2) Related Art

Holsters for handguns are known in the art. Most commonly they are designed for carrying handguns externally, e.g., as seen in FIG. 1. In many situations, however, external carry is not ideal. For example, for those wishing to be discrete, for concealed carry, for backup carry, for off-duty police officers, for intelligence organizations, for military Special Forces, etc., it may be desirable to carry the handgun inside the waistline.

Others have attempted to develop carrying systems for carrying handguns inside the waistline with little success. Applicants have successfully developed holsters for comfortably and securely carrying handguns inside the waistline (see e.g. commonly owned U.S. patent application Ser. No. 12/946,405, the entire contents of which are hereby incorporated by reference). Despite the many benefits of Applicants' related technology, re-holstering often requires the removal of the holster and two handed interface of handgun to holster.

Thus, there remains a need for a new and improved holster for a handgun which includes the benefits of Applicants' related technology while, at the same time, provides easier and more secure re-holstering.

SUMMARY

The present inventions is directed to, inter alia, holsters and methods of making holsters. In one embodiment, the holster includes a body-interface-surface (BIS) having a body-side (BS) and a handgun-side (GS). A rigid mold is interfaced with the BIS. A gun-lock region is configured that may move toward the channel of the rigid mold, may allow compression of the BIS and/or may be sufficiently rigid as to develop a positive retention of the handgun in the holster, when the holster is positioned on a wearer's beltline. A clip may additionally be interfaced with the rigid mold.

In another embodiment, a method of forming a holster comprises sandwiching at least three layers together to form a BIS, facing one side of the BIS toward a body-side (BS), facing one side of the BIS toward a gun-side (GS), including a compression layer, attaching a rigid mold, and creating a positive gun-retention channel between the ridged mold and the BIS. A clip may be attached to the rigid mold.

Accordingly, one aspect of the present inventions is to provide a holster for carrying a handgun inside a wearer's beltline, the holster including (a) a body-interface-surface (BIS) having a body-side (BS) and a gun-side (GS), wherein the BIS has a flexibility sufficient to mold to the wearer's body, and wherein the BIS has a surface area larger than the side profile of the handgun; and (b) a rigid mold defining a channel for receiving the handgun, the rigid mold interfaced with the GS of the BIS forming a gun-lock region.

Another aspect of the present inventions is to provide a holster for carrying a handgun inside a wearer's beltline, the holster including (a) a body-interface-surface (BIS) having a body-side (BS), a gun-side (GS), and a compression layer, wherein the BIS has a flexibility sufficient to mold to the wearer's body and wherein the BIS has a surface area larger than the side profile of the handgun; and (b) a rigid mold defining a channel for receiving the handgun, the rigid mold interfaced with the GS of the BIS forming a gun-lock region.

Still another aspect of the present inventions is to provide a holster for carrying a handgun inside a wearer's beltline, the holster including (a) a body-interface-surface (BIS) having a body-side (BS), a gun-side (GS), and a compression layer, wherein the BIS has a flexibility sufficient to mold to the wearer's body and wherein the BIS has a surface area larger than the side profile of the handgun; (b) a rigid mold defining a channel for receiving the handgun, the rigid mold interfaced with the GS of the BIS forming a gun-lock region; and (c) a clip interfaced with the rigid mold.

The above summary is intended to summarize certain embodiments of the present inventions. Embodiments will be set forth in more detail in the figures and detailed description below. It will be apparent, however, that the detailed description is not intended to limit the present inventions, the scope of which should be properly determined by the appended claims.

DESCRIPTION OF THE PREFERRED EMBODIMENTS

Figure 1:
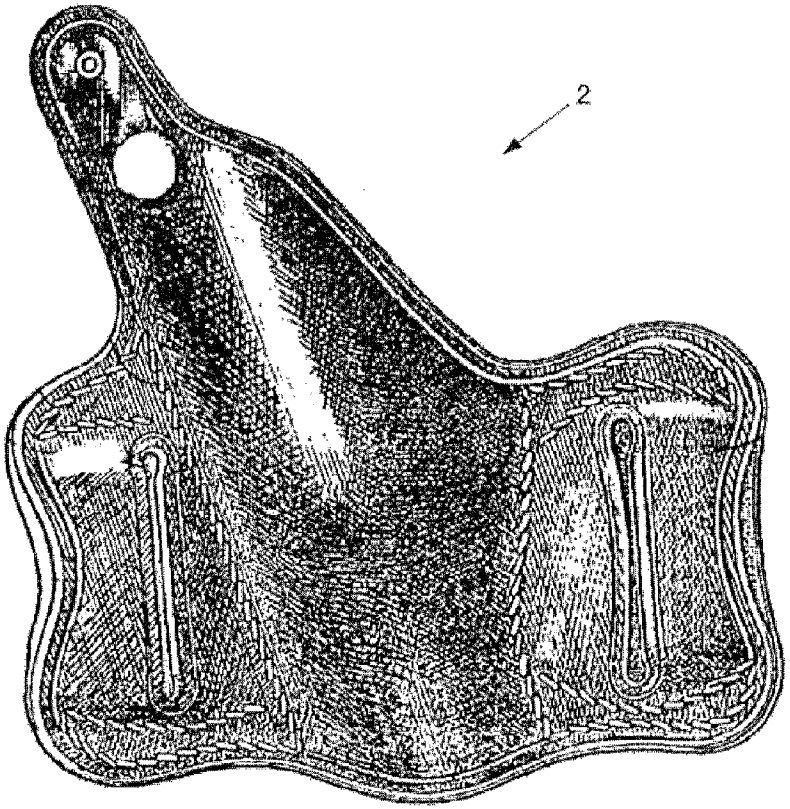
FIG. 1 PRIOR ART
FIG. 1 shows a prior art handgun holster.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
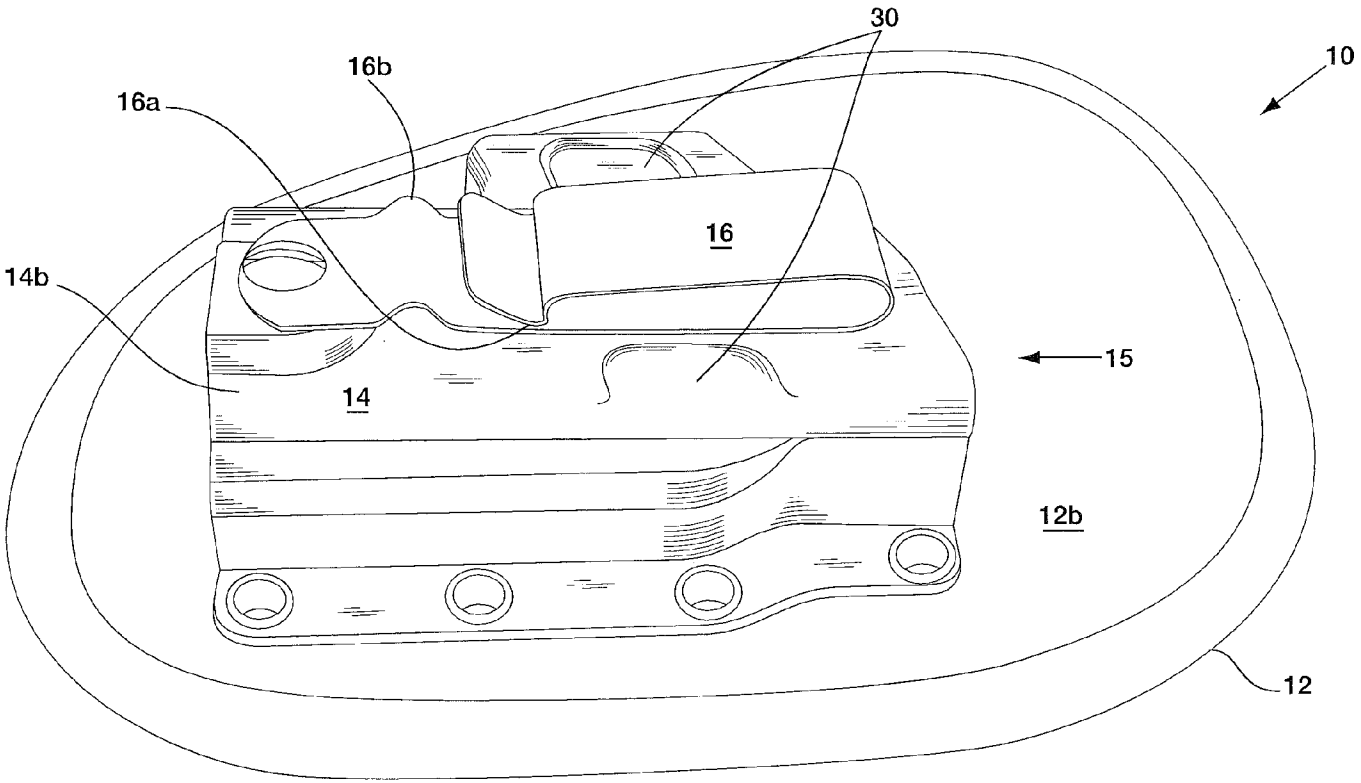
FIG. 2 shows a perspective view of one embodiment of a handgun holster constructed according to the present inventions.

Referring now to the drawings in general and FIG. 1 in particular, it will be understood that the illustrations are for the purpose of describing a preferred embodiment of the inventions and are not intended to limit the inventions thereto. As best seen in FIG. 2, a holster for a handgun, generally designated 10, is shown constructed according to the present inventions. Holster 10 includes a body-interface-surface (BIS) 12 and a rigid mold 14. Holster 10 may further include a clip 16 interfaced with the rigid mold 14.

BISs may vary from embodiment to embodiment, but typically include body-side (BS) 12*a* (see e.g. FIG. 4) and a gun-side (GS) 12*b*. BSs are configured to face the wearer's body, while GSs are configured to face the handgun.

BISs have a flexibility sufficient to mold to the wearer's body. The BIS may mold around the hip, the rear of the hip, the front of the hip, the small of the back, the front of the waist, etc. A variety of materials may have sufficient flexibility to achieve the desired mold. BISs may have a surface area larger than the side profile of the handgun 15 (the function of the surface area is further discussed below).

Figure 4:
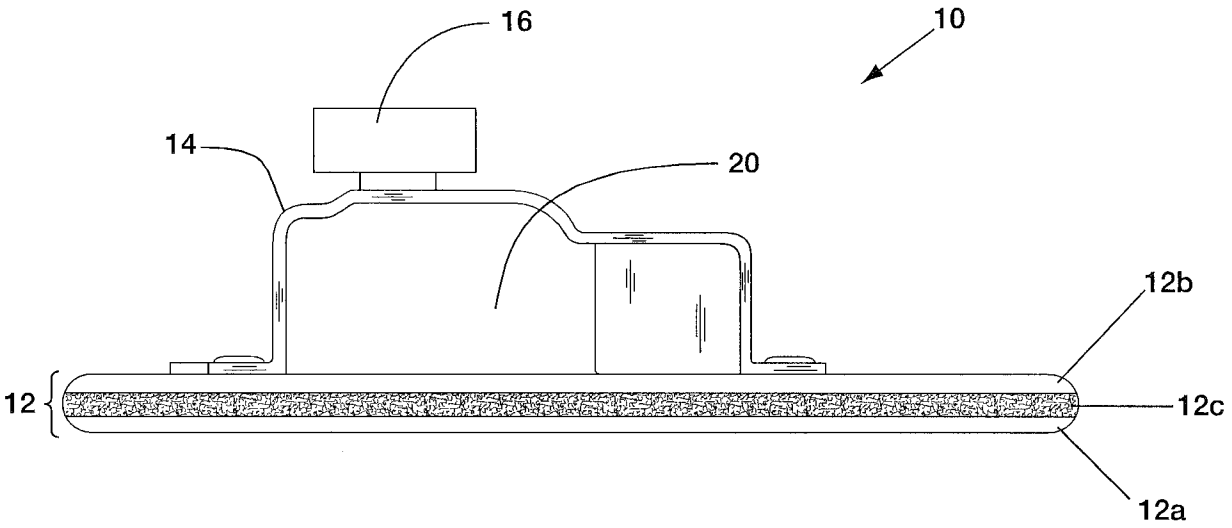
FIG. 4 shows a top view of one embodiment of the inventions shown in FIG. 2 with a cut away view of the BIS.

BISs will typically include a BS-layer 12*a*, a GS-layer 12*b*, and a compression layer 12*c* positioned between BS-layer and GS-layer (see e.g. FIG. 4). In typical embodiments, BS-layers have a thickness of about 0.5 to about 3.0 mm, more typically about 1.2 mm. GS-layers have a thickness of about 0.5 to about 3.0 mm, more typically about 1.4 mm. Compression layers have a thickness of about 0.5 to about 3.0 mm, more typically about 2 mm. Thickness of the layers, and overall thickness of the BIS contributes to the ability of the current holster to both mold to the wearer's body and to allow for carrying inside the waist band. If the BIS becomes too thick then it may become resistant to molding to the wearer's body and/or may become too thick for insertion inside the waist band of wearer, preventing successful and comfortable concealed carry.

Typically, the BS-layer includes leather, more typically, leather having a suede finish. Applicants have discovered that in the particular configuration and construction of holsters of the invention, the coefficient of friction of suede against the body, e.g., a wearer's skin or clothing is sufficient to greatly contribute to the overall stability of the platform. Materials having similar coefficients of friction are also considered suitable. The BS-layer may cover the complete BS-side to any selvedge, creating a smooth uniform surface layer. Typically, the GS-layer includes leather, but other materials may also be suitable.

In most embodiments, the GS of the BIS is substantially, e.g., greater than 50%, or entirely, e.g., greater than 90%, formed by the GS-layer. Somewhat similarly, in most embodiments, the BS of the BIS is substantially, e.g., greater than 50%, or entirely, e.g., greater than 90%, formed by the BS-layer.

In many embodiments, compression layer 12*c* is formed from neoprene, e.g., about 2 mm thick and backed on each side with nylon. Varying from embodiment to embodiment, compression layers typically have a surface area of at least 60%, at least 65%, at least 70%, at least 75%, at least 80%, at least 85%, at least 90%, at least 95% and at least 99% of the side profile of the handgun. Somewhat similarly, compression layers may have a surface area of at least 60%, at least 65%, at least 70%, at least 75%, at least 80%, at least 85%, at least 90%, at least 95% and at least 99% of the BS-layer. Even more typically, compression layers will cover the complete BIS, e.g. to the selvedge, creating a smooth uniform layer.

Compression layers typically provide at least two functions. For example, they cushion the user from the handgun to allow for comfortable carrying. Additionally, they may allow the handgun's shape to define a compression with the BIS, thereby increasing the holster's purchase on the handgun and stability while being carried.

Materials used in construction of the BIS may vary from embodiment to embodiment, so long as desired function is maintained.

As seen in FIG. 2, holsters also include a rigid mold, e.g., mold 14. Mold 14 is typically interfaced with the GS of the BIS, e.g. with side flanges for mounting. Rigid molds typically have a height 14*a* sufficient to cover at least one of ¼, ⅓ or ½ or more of the height of the side profile of the handgun. As shown, rigid mold 14 includes an outside surface 14*b* having a rigidity sufficient to maintain its own shape when a handgun is not contained in the channel, e.g. the shape of a partial handgun. A variety of materials, e.g. polymers, may be used to create a mold having the sufficient rigidity. By way of example, a polycarbonate may be used for making the mold 14. The rigid mold defines, at least in part a channel 20 (see e.g. FIG. 4).

In this example, channel 20 is defined at its outside surface by rigid mold 14 and at its inside surface by the flexible GS layer 12*b*. In other examples, channels may be formed at their inside surface by other materials, e.g., polymers having more or less flexibility than the rigid mold 14. Accordingly, in some examples, the rigid mold will not include an inner surface, e.g., it will be substantially arch shaped as illustrated in FIG. 4 or may further include a liner.

As illustrated primarily in FIGS. 6, 7, 7A and 7B, holster 10, may also include a gun-lock region. The gun-lock region may include/be defined by the BIS or a portion of the BIS (for example, the GS), the channel 20 and/or the rigid mold 14. The gun-lock region may be configured so that the GS of the BIS moves toward the channel 20 of the rigid mold when the holster is positioned on a wearer's beltline. In many examples, the movement toward channel 20 of the GS generates a force sufficient to retain the handgun when the holster is positioned on a wearer's beltline (as placing the holster on the body generates the movement inward of the GS sufficient to create the force) and, wherein the gun-lock region does not generate a force sufficient to retain the handgun when not on a wearer's beltline. The result is a system that allows for comfortable and secure carrying of a handgun. The handgun can be withdrawn with force by the user but will remain secured by, inter alia, the gun-lock region during carrying.

Alternatively, the gun-lock region may be formed not by movement toward channel 20 of the GS 12*b*, but may be defined by GS 12*b* opposing mold 14 in a manner to create positive retention of the handgun by securing the handgun firmly between the mold 14 and GS 12*b*. By way of example, the compression layer 12*c* may allow the GS 12*b* to compress toward the wearer, away from the channel 20, or the BIS may maintain a position in order to accommodate the handgun while maintaining the positive retention of the holster 10 when the handgun is placed into the channel 20.

Figure 7:
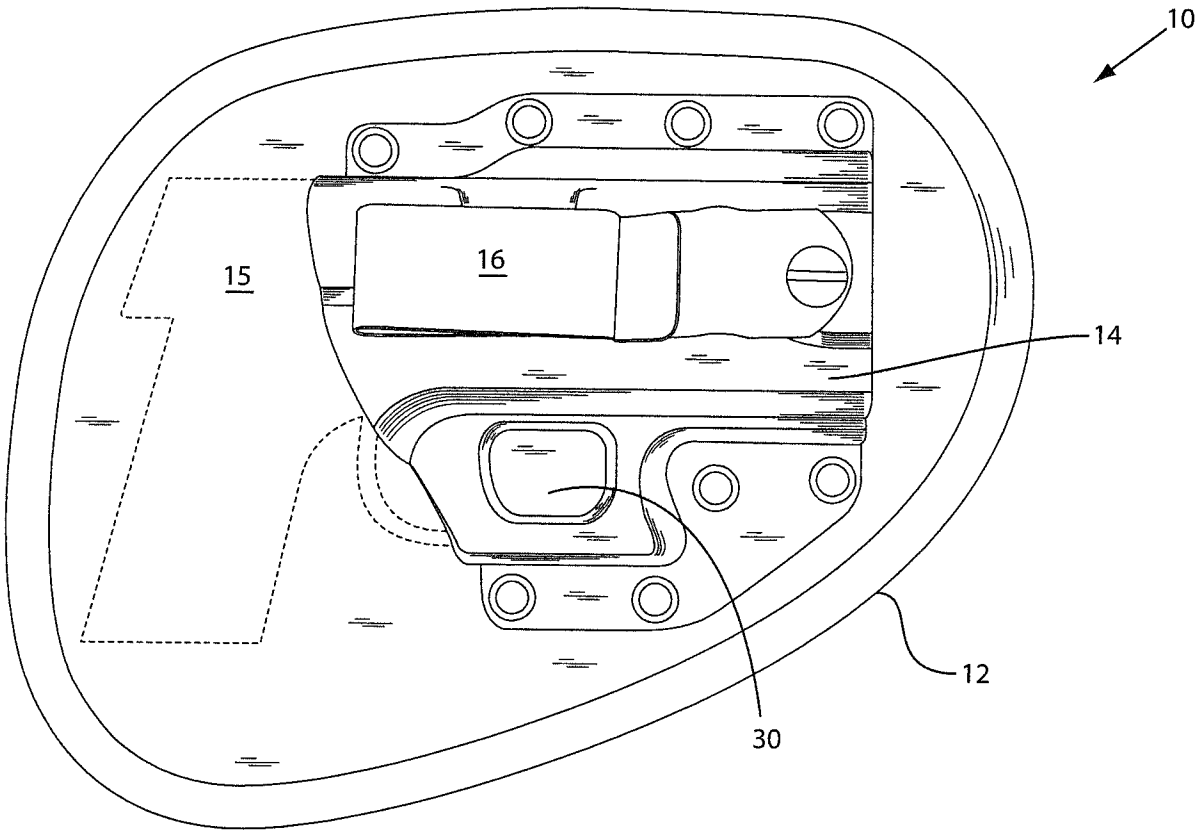
FIG. 7 shows a side view of one embodiment of the inventions shown in FIG. 2 with a handgun holstered.
Figure 7A:
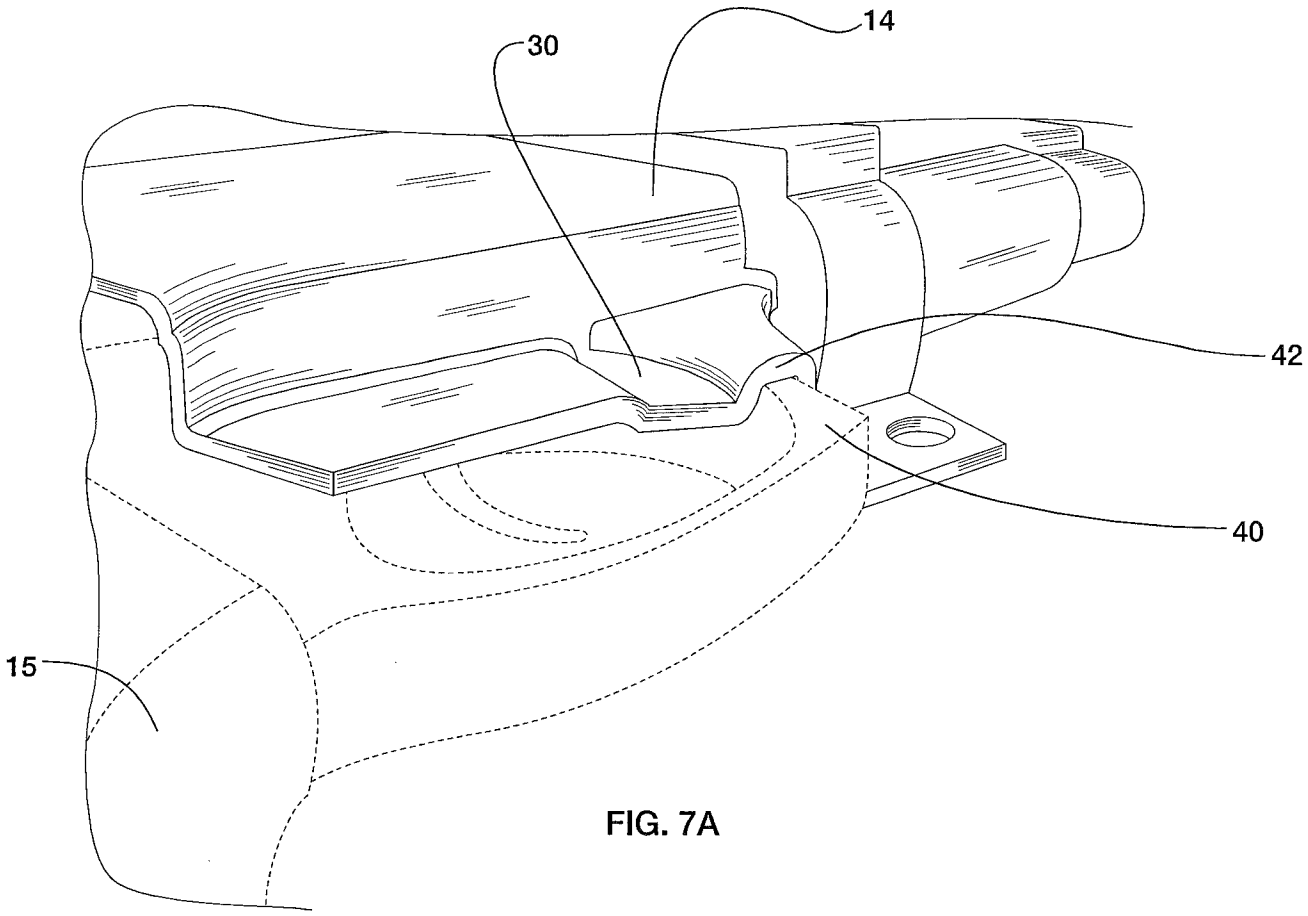
FIG. 7A shows a close up cut away view of the trigger area of the embodiment of the invention as shown in FIG. 7 with a handgun holstered.
Figure 7B:
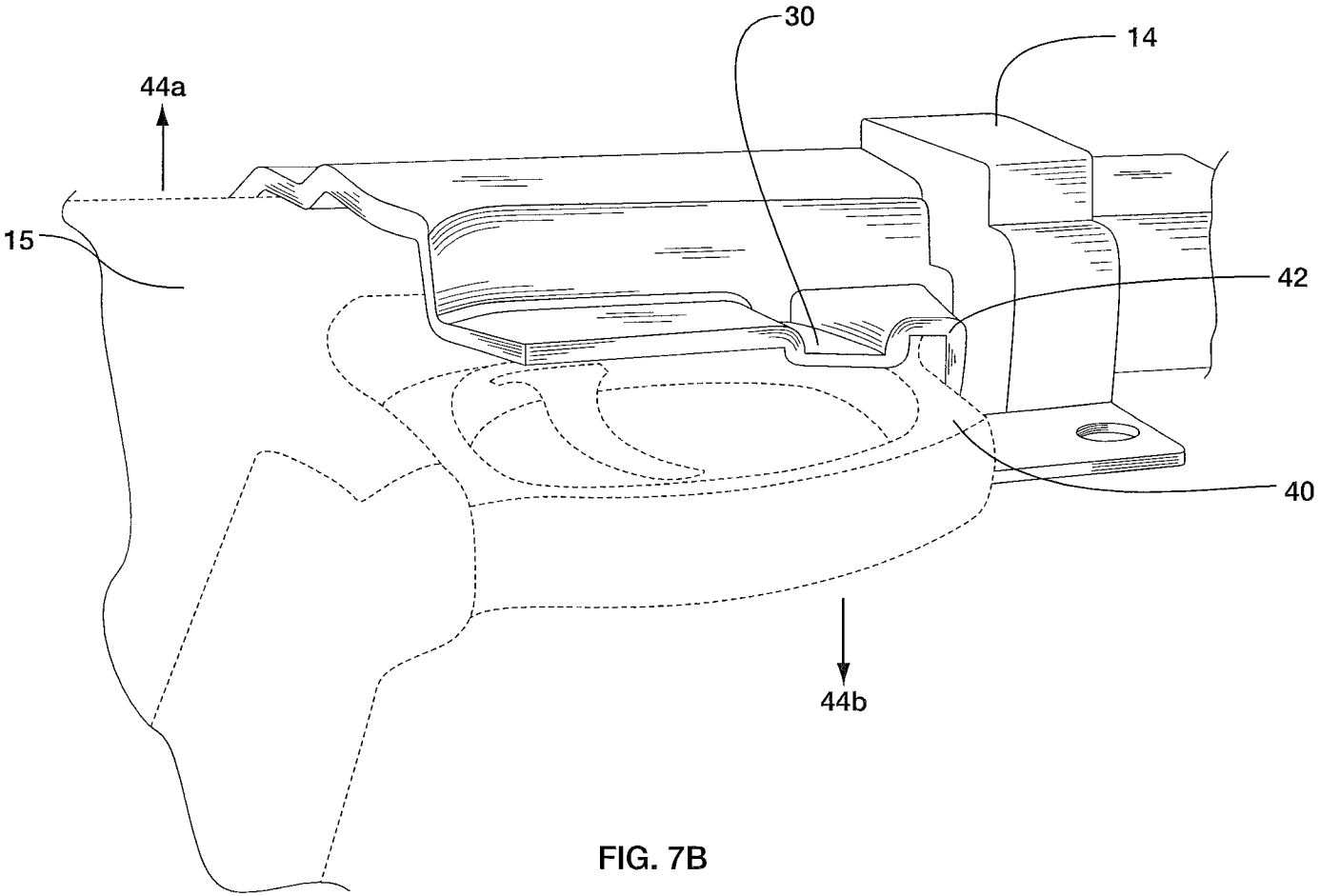
FIG. 7B shows a close up cut away view of the trigger area of the embodiment of the invention as shown in FIG. 7 as the handgun is manipulated for release from the holster.

In yet another embodiment, the mold 14 may include one or more retention bumps 42 (see e.g. FIGS. 7A and 7B). The one or more retention bumps 42 may take on various shapes or locations to accommodate the design of different caliber handguns, handgun body styles and/or handgun accessories. The one or more retention bumps 30 typically are structured from depressions 30, so as to interface with depressions or projections on the handgun body, such as the trigger guard 40. The one or more retention bumps 42 may interface with the handgun so as to lock the handgun in place within the channel 20. The mold 14 and the GS 12*b* may typically be rigid enough to securely hold the handgun within the holster 10. Retention bumps 42 correspond to depressions/protrusions 30 mimicking the contour of the body of the handgun. By way of example, a depression 30 may be structured so as to contour retention bump 42 to correspond to a trigger guard 40 on a handgun, as best seen in FIG. 7A.

In operation, to unlock a secured handgun from the holster 10, a twisting motion allows the wearer to unlock and withdraw the handgun with one-handed operation. The wearer is able to grasp the handgun by placing their thumb between the holster and the grip and then slightly twisting the grip toward the wearer's body. The compression layer 12*c* may give enough toward the wearer's body and away from the channel 20, to allow the wearer a smooth draw from within the holster 10. In embodiments where the GS 12*b* is moving toward the channel 20, the twist may be enough to allow the wearer to release and retract the handgun from the holster.

In other embodiments, the wearer may twist the grip toward the body in order to release the trigger guard (see e.g. FIG. 7B, 44*a* and 44*b*) or other handgun part 40 from the retention bump 42. As best seen in FIG. 7A, the trigger guard 40 nestles into the retention bump 42. The BIS compresses enough to allow the slight twisting of the handgun 44*a*, 44*b* by the wearer and release of the trigger guard 40 as seen in FIG. 7B. By unlocking the handgun with the twisting motion, the positive retention force is released, enabling the wearer a smooth draw. Therefore, the holster 10 allows the handgun to be holstered with one-handed operation, secures the handgun without the need for a strap and prevents accidental removal or the firearm, while still allowing twistable release and retraction of the handgun with one-handed operation.

Figure 3:
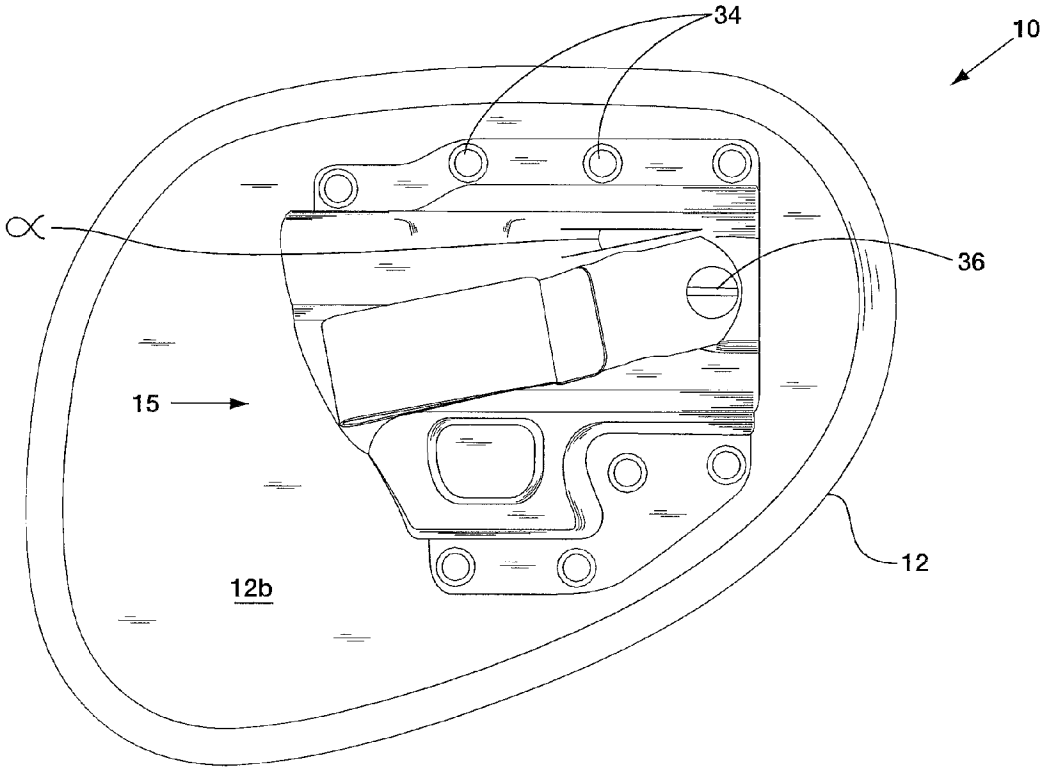
FIG. 3 shows a side view of one embodiment of the inventions shown in FIG. 2.

Clip 16 is interfaced with the rigid mold, as best seen in FIG. 3. Any clip having a size and rigidity suitable for affixing a holster as described herein inside of a wearer's pants may be sufficient. In some embodiments, the angle $\alpha$ of the clip's positioning may be adjusted to facilitate the carrying of the holster in different positions, typical $\alpha$ angles will be chosen from about 0 to about 30 degrees.

Figure 5:
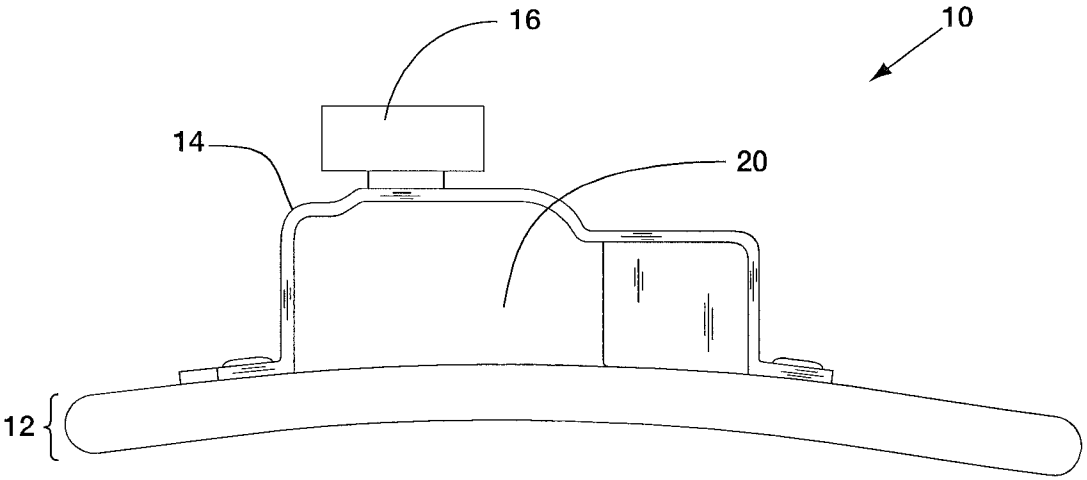
FIG. 5 shows another side view of one embodiment of the inventions shown in FIG. 2 with a cut away view of the BIS.
Figure 6:
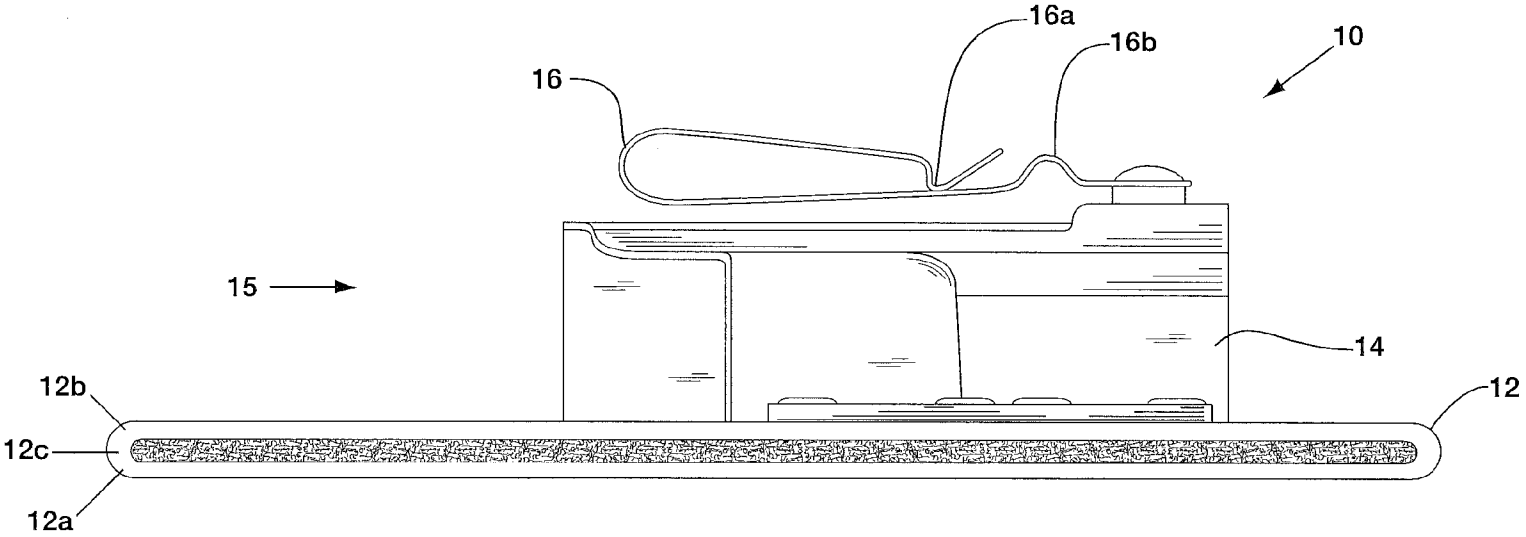
FIG. 6 shows a side view of one embodiment of the inventions shown in FIG. 2 with a cut away view of the BIS.

In some examples, the rigid mold may include at least a first plane at the outside of the rigid mold 14*a*. In some examples, the outside of the rigid mold may include a series of planes at progressively outward positions. At least one clip 16 may be located on a portion of the rigid mold that protrudes outwardly from a first plane at the outside of the rigid mold 14*a*. The clip 16 may interface with the mold 14 at a second plane outwardly located from the first plane (FIGS. 4-6).

The above described holster allows for the secure and stable carrying of a handgun inside a wearer's waistline. It allows for surprisingly discrete, comfortable and stable carry due to the construction of the holster. Further, holsters of the inventions allow for improved access to a handgun because Applicants' holsters allow for handguns to be carried without the need for a latch or snap on the holster. Others will no doubt observe other advantages.

Inventions also include methods of forming a holster for carrying a handgun inside a wearer's beltline. In typical embodiments, a method comprises sandwiching at least three layers together to form a BIS; attaching an rigid mold to the BIS; and attaching a clip to the rigid mold. The at least three layers, the BIS, the rigid mold, and the clip can be any of those described above. Methods typically include attaching selvedge to the edge of the three layers, e.g., to secure the sandwich structure.

Numerous characteristics and advantages have been set forth in the foregoing description, together with details of structure and function. The disclosure, however, is illustrative only, and changes may be made in detail, especially in matters of shape, size and arrangement of parts, within the principle of the invention, to the full extent indicated by the broad general meaning of the terms in which the general claims are expressed.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein, and every number between the end points. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10, as well as all ranges beginning and ending within the end points, e.g. 2 to 9, 3 to 8, 3 to 9, 4 to 7, and finally to each number 1, 2, 3, 4, 5, 6, 7, 8, 9 and 10 contained within the range. Additionally, any reference referred to as being "incorporated herein" is to be understood as being incorporated in its entirety. It is further noted that, as used in this specification, the singular forms "a," "an," and "the" include plural referents unless expressly and unequivocally limited to one referent.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A holster for carrying a handgun inside a wearer's beltline, said holster comprising:

(a) a body-interface-surface (BIS) having:

a height and a width, with a first peripheral edge and a second peripheral edge along the height of the body-interface surface (BIS), a body-side (BS) with a wearer contact surface, a gun-side (GS) with a gun contact surface, the BIS having a portion adapted to be positioned to extend upward and forming a barrier between the wearer and the entirety of a holstered handgun;

(b) a rigid mold having a first side and a second side and defining a channel having an opening for receiving the handgun, the rigid mold interfaced with the gun contact surface of the GS, the rigid mold forming a twist and release gun-lock region; wherein the first side of the rigid mold further includes at least one retention bump and at least one depression and the at least one retention bump and at least one depression are adapted to correspond to a trigger guard on the handgun that is accommodated by the channel, such that a twisting motion allows the wearer to unlock the holstered handgun from the gun-lock region and withdraw the holstered handgun by placing a thumb between the holster and a grip and slightly twisting the grip, the rigid mold comprising a first outside surface plane having an upper surface of the rigid mold being located toward the opening and a bottom surface of the rigid mold being located toward a distal end of the rigid mold away from the upper surface, and (c) a clip interfaced with an outwardly projecting portion of the rigid mold, the clip interface located in a second plane spaced apart from a first plane of the outside surface of the rigid mold by a raised portion, the raised portion forming a bump contained near the bottom surface of the rigid mold and not extending to the upper surface, wherein the pivotally supported clip is pivotable about an axis that passes perpendicularly through the raised portion and is pivotable substantially parallel to the outside surface of the rigid mold and the gun contact surface at an angle alpha chosen from about 0 to about 30 degrees to alternately position the holster at varying positions between a straight drop and a cant.

2. The holster according to claim 1, wherein the clip further includes a clamp.

3. The holster according to claim 2, wherein the clip further includes a pressure point in proximity to the clamp.

4. The holster according to claim 1, wherein the gun-lock region forms a positive retention on the handgun within the holster.

5. The holster according to claim 1, wherein the rigid mold includes an outside surface having a rigidity sufficient to maintain its own shape when a handgun is not contained in the channel.

6. The holster according to claim 5, wherein the channel, defined at least in part by the rigid mold, is defined by the outside surface of the rigid mold on one side and by a surface having lesser rigidity than the rigid mold on the opposite side.

7. The holster according to claim 6, wherein the surface of lesser rigidity includes the GS.

8. The holster according to claim 1, wherein the rigid mold further includes a less rigid inner surface.

9. The holster according to claim 1, wherein the gun-lock region is configured to generate a force sufficient to retain the handgun when the holster is positioned on a wearer's beltline and, wherein the gun-lock region does not generate a force sufficient to retain the handgun when not on a wearer's beltline.

10. The holster according to claim 1, wherein the rigid mold includes a polymer portion.

11. The holster according to claim 1, wherein the compression layer, the BS-layer and the GS-Layer are separate and distinct layers and the compression layer is positioned between the BS-layer and the GS-layer and enclosed between the BS-layer and the GS-layer by a selvedge.

12. The holster according to claim 11, wherein the BS-layer has a thickness of about 0.5 to about 3.0 mm, the GS-layer has a thickness of about 0.5 to about 3.0 mm, and the compression layer has a thickness of about 0.5 to about 3.0 mm.

13. The holster according to claim 11, wherein the compression layer includes neoprene.

14. The holster according to claim 13, wherein the neoprene is backed on at least one side with nylon.

15. The holster according to claim 11, wherein the compression layer has a compression sufficient to contribute to the purchase of the handgun.

16. A handgun holster for carrying a handgun inside a wearer's beltline, said holster comprising:

(a) a body-interface-surface (BIS) having a body-side (BS) with a wearer contact surface and a gun-side (GS) with a gun contact surface, wherein the BIS has a flexibility sufficient to mold to the wearer's body, the BIS having a lower portion and an upper portion, the upper portion adapted to be positioned to extend upward and between the wearer and the entirety of a holstered handgun and the lower portion adapted to support a rigid mold on the gun contact surface;

(b) the rigid mold and the gun contact surface defining a channel, the channel having an opening in the rigid mold for receiving a handgun, the rigid mold comprising a first outside surface plane having an upper surface of the rigid mold being located toward the opening and a bottom surface of the rigid mold being located toward a distal end of the rigid mold away from the upper surface, the rigid mold also having a first side and a second side, the first side having at least one retention bump and at least one depression adapted to correspond to a trigger guard on a holstered handgun;

(c) the gun contact surface, the retention bump and the depression collectively forming a twist-release gun lock region and each include structure adapted to cooperatively enable the holster to engage a positive retention on a holstered handgun until a grip of the handgun is twisted toward the wearer;

the structure of the gun contact surface is of a lesser rigidity than the rigid mold, wherein the gun contact surface is movable between a first nonbiased position when not worn by a user and a second biased position when worn by a user;

the structure of the depression includes an inward projecting portion, the inward projecting portion configured to project into a space inside a trigger guard of a holstered handgun;

the structure of the retention bump includes a recess adapted to accept the trigger guard of a holstered handgun that has cleared the inward projecting portion, wherein the twist-release region is configured to secure a holstered handgun under the positive retention until the grip is twisted toward the wearer, releasing the trigger guard from the recess and clearing the trigger guard past the inward projecting portion enabling a clean release of the handgun from the holster, and (d) at least one pivotally supported clip attached on a portion of the rigid mold that protrudes outwardly from the first outside surface plane, the portion located near the bottom surface of the rigid mold and remaining in the bottom third of the mold, wherein the pivotally supported clip is pivotable about an axis that passes perpendicularly through the mold and is substantially parallel to the outside surface of the rigid mold and the gun contact surface, at an angle alpha chosen from about 0 to about 30 degrees to alternately position the holster at varying positions between a straight drop and a cant.

17. The holster according to claim 16 wherein the portion of the rigid mold that protrudes outwardly includes a second plane outwardly extended from and parallel to the first outside surface plane, the clip interfacing with the rigid mold at the second plane of the rigid mold.

18. The holster according to claim 17, wherein the clip further includes a clamp above a lower portion of the rigid mold.

19. The holster according to claim 18, wherein the clip further includes a pressure point above the lower portion and below the clamp.

20. The holster according to claim 17, wherein the clip is variably positionable in an angle alpha chosen from about 0 to about 30 degrees bi-directionally.

21. The holster according to claim 16, wherein the gun-lock region is adapted to form a positive retention on a holstered handgun without the use of a tension screw.

22. The holster according to claim 16, wherein the rigid mold includes an outside surface having a rigidity sufficient to maintain its own shape when a handgun is not contained in the channel.

23. The holster according to claim 22, wherein the channel, defined at least in part by the rigid mold, is defined by the outside surface of the rigid mold on one side and by a surface having lesser rigidity than the rigid mold on the opposite side.

24. The holster according to claim 23, wherein the surface of lesser rigidity allows a compression toward the user.

25. The holster according to claim 16, wherein the rigid mold further includes a less rigid inner surface.

26. The holster according to claim 16, wherein the second biased position of the gun contact surface is maintained in the gun-lock region when the holster is worn by a user and the gun-lock region is configured to generate a force sufficient to retain the handgun when the holster is positioned on a wearer's beltline and, wherein the gun-lock region does not generate a force sufficient to retain the handgun when not on a wearer's beltline.

27. The holster according to claim 1, wherein the rigid mold includes a polymer portion.

28. A holster for carrying a handgun inside a wearer's beltline, said holster comprising:

(a) a body-interface-surface (BIS) having a body-side (BS) with a wearer contact surface, a gun-side (GS) with a gun contact surface, the wearer contact surface and the gun contact surface being at least partially separated by a compression layer, wherein the BIS has a flexibility sufficient to mold to the wearer's body, and includes a portion adapted to be positioned to extend upward such that a portion of the holster is between the wearer and the entirety of a holstered handgun so that the BIS forms a barrier between the entirety of the handgun and the wearer;

(b) a rigid mold defining a channel with the gun contact surface having an opening for receiving the handgun, the rigid mold including a first side and a second side, the first side having at least one retention bump and at least one depression and the at least one retention bump and at least one depression are adapted to correspond to a trigger guard on a holstered handgun that is accommodated by the channel, wherein the gun contact surface, the retention bump and the depression collectively form a twist-release gun lock region and each include structure adapted to cooperatively enable the holster to engage a positive retention on a holstered handgun until a grip of the handgun is twisted toward the wearer; the structure of the gun contact surface is of a lesser rigidity than the rigid mold and wherein the gun contact surface is movable between a first nonbiased position when not worn by a user and a second biased position when worn by a user; the structure of the depression includes a inwardly projecting portion, the inwardly projecting portion configured to project into a space inside a trigger guard of a holstered handgun; the structure of the retention bump includes a recess adapted to accept the trigger guard of a holstered handgun that has cleared the inwardly projecting portion, wherein the twist-release region is configured to secure a holstered handgun under the positive retention until the grip is twisted toward the wearer, releasing the trigger guard from the recess and clearing the trigger guard past the inwardly projecting portion enabling a clean release of the handgun from the holster, and (c) the rigid mold comprising a first outside surface plane having an upper surface of the rigid mold being located toward the opening and a bottom surface of the rigid mold being located toward a distal end of the rigid mold away from the upper surface, at least one pivotally supported clip attached on a portion of the rigid mold that protrudes outwardly from the first outside surface plane, the portion located near the bottom surface of the rigid mold and remaining in the bottom third of the mold, wherein the pivotally supported clip is pivotable about an axis that passes perpendicularly through the mold and is pivotable in a pivot plane that is substantially parallel to the outside surface of the rigid mold and the gun contact surface at an angle alpha chosen from about 0 to about 30 degrees to alternately position the holster at varying positions between a straight drop and a cant.

29. The holster according to claim 28, wherein the compression layer allows a compression inward, toward the wearer, of the BIS sufficient to allow a depression in the shape of the handgun in the BIS when the holster is in use inside the wearer's beltline.

30. The holster according to claim 29, wherein the BS-layer has a thickness of about 0.5 to about 3.0 mm, the GS-layer has a thickness of about 0.5 to about 3.0 mm, and the compression layer has a thickness of about 0.5 to about 3.0 mm.

31. The holster according to claim 29, wherein the compression layer includes neoprene.

32. The holster according to claim 31, wherein the neoprene is backed on at least one side with nylon.

33. The holster according to claim 29, wherein the compression layer has a compression sufficient to contribute to the purchase of the handgun.

34. A method of holstering a handgun for wearing inside a wearer's beltline, said method comprising the steps of:

forming a BIS with a portion adapted to extend upward such that a barrier is between the wearer and the entirety of a holstered handgun;

facing one side of the BIS toward a body-side (BS);

facing one side of the BIS toward a gun-side (GS) having a gun contact surface, wherein the gun contact surface is movable between a first nonbiased position when not worn by a user and a second biased position when worn by a user;

attaching a rigid mold to the BIS, the rigid mold having an opening for receiving a handgun, the mold including an upper surface of the rigid mold located toward the opening and a bottom surface of the rigid mold located toward a distal end of the rigid mold away from the upper surface;

including a retention bump and a depression in the rigid mold;

creating a positive gun-retention channel between the rigid mold and the BIS wherein the gun contact surface, the retention bump and the depression collectively form a twist-release gun lock region in the channel and each include structure adapted to cooperatively enable the holster to engage a positive retention on a holstered handgun until a grip of the handgun is twisted toward the wearer; the structure of the gun contact surface is of a lesser rigidity than the rigid mold; the structure of the depression includes an inwardly projecting portion, the inwardly projecting portion configured to project into a space inside a trigger guard of a holstered handgun; the structure of the retention bump includes a recess adapted to accept the trigger guard of a holstered handgun that has cleared the inward projecting portion, wherein the twist-release region is configured to secure a holstered handgun under the positive retention until the grip is twisted toward the wearer, releasing the trigger guard from the recess and clearing the trigger guard past the inwardly projecting portion, enabling a clean release of the handgun from the holster, attaching a clip to an outwardly projecting portion of the rigid mold toward the bottom surface of the rigid mold such that the portion remains in the bottom third of the mold, and pivotally supporting the clip about a perpendicular axis that passes through the mold and is pivotable substantially parallel to the outside surface of the rigid mold and the gun contact surface at an angle alpha chosen from about 0 to about 30 degrees to alternately position the holster at varying positions between a straight drop and a cant.

* * * * *